US005267356A

United States Patent [19]

Gideon et al.

[11] Patent Number: 5,267,356

[45] Date of Patent: Dec. 7, 1993

[54] COMMODE SEAT LOWERING APPARATUS

[76] Inventors: William W. Gideon, 3862 E. Kerckhoff, Fresno, Calif. 93702; George C. Gideon, 1417 Burnham Dr., Selma, Calif. 93662

[21] Appl. No.: 988,859

[22] Filed: Dec. 10, 1992

[51] Int. Cl.[5] ..... A47K 13/10

[52] U.S. Cl. ..... 4/246.2; 4/248; 16/69

[58] Field of Search ..... 4/236, 240, 241, 246.1, 4/246.2, 248; 188/302, 305; 16/66, 68, 69, 84

[56] References Cited

U.S. PATENT DOCUMENTS

| | | | |
|---|---|---|---|
| 491,155 | 2/1893 | Wright | 16/69 |
| 617,106 | 1/1899 | Larsen | 16/69 |
| 747,757 | 12/1903 | Ogden | 16/69 |
| 1,921,121 | 8/1933 | Head | 188/305 X |
| 1,942,185 | 1/1934 | Richter et al. | 16/69 |
| 2,200,687 | 5/1940 | Bercot | 4/246.1 |
| 3,404,411 | 10/1968 | Newkirk | 4/246.1 |
| 3,781,924 | 1/1974 | Davis, Jr. | 4/246.2 |
| 4,984,666 | 1/1991 | Orii et al. | 4/236 X |
| 5,153,946 | 10/1992 | Yoke et al. | 4/248 |

*Primary Examiner*—Henry J. Recla
*Assistant Examiner*—Robert M. Fetsuga
*Attorney, Agent, or Firm*—Leon Gilden

[57] ABSTRACT

A lowering apparatus is arranged to include a commode seat arranged for biased displacement from a first orientation oriented at an obtuse included angle relative to the commode to a second position at an acute orientation relative to the commode, whereupon the commode seat is then lowered by means of gravity and wherein the gravity pull is dampened by use of a pneumatic cylinder mounted within a dampening housing, wherein the pneumatic cylinder is controlled by means of a bleed valve to control the dampening action.

4 Claims, 4 Drawing Sheets

COMMODE SEAT LOWERING APPARATUS

BACKGROUND OF THE INVENTION

1. Field of the Invention

The field of invention relates to commode apparatus, and more particularly pertains to a new and improved commode seat lowering apparatus wherein the same is arranged to provide for the automatic and controlled lowering of a commode seat relative to a commode.

2. Description of the Prior Art

Commode apparatus of various types is indicated in the prior art, wherein U.S. Pat. Nos. 4,912,783; 4,914,757; 4,839,928; 4,951,325; and 4,995,120 are all directed to prior art commode lid control structure.

The instant invention is directed to overcome deficiencies of the prior art by providing for controlled lowering of the commode seat relative to an associated commode by the initial spring-biasing of the commode seat to a position to permit gravity pull of the commode seat and dampening of the commode seat upon gravity pull of the commode seat in the lowering of the commode seat relative to an associated commode.

SUMMARY OF THE INVENTION

In view of the foregoing disadvantages inherent in the known types of commode seat lower apparatus now present in the prior art, the present invention provides a commode seat lowering apparatus wherein the same is directed to the controlled lowering of a commode seat relative to an associated commode. As such, the general purpose of the present invention, which will be described subsequently in greater detail, is to provide a new and improved commode seat lowering apparatus which has all the advantages of the prior art commode seat lowering apparatus and none of the disadvantages.

To attain this, the present invention provides a lowering apparatus arranged to include a commode seat arranged for biased displacement from a first orientation oriented at an obtuse included angle relative to the commode to a second position at an acute orientation relative to the commode, whereupon the commode seat is then lowered by means of gravity and wherein the gravity pull is dampened by use of a pneumatic cylinder mounted within a dampening housing, wherein the pneumatic cylinder is controlled by means of a bleed valve to control the dampening action.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved commode seat lowering apparatus which has all the advantages of the prior art commode seat lowering apparatus and none of the disadvantages.

It is another object of the present invention to provide a new and improved commode seat lowering apparatus which may be easily and efficiently manufactured and marketed.

It is a further object of the present invention to provide a new and improved commode seat lowering apparatus which is of a durable and reliable construction.

An even further object of the present invention is to provide a new and improved commode seat lowering apparatus which is susceptible of a low cost of manufacture with regard to both materials and labor, and which accordingly is then susceptible of low prices of sale to the consuming public, thereby making such commode seat lowering apparatus economically available to the buying public.

Still yet another object of the present invention is to provide a new and improved commode seat lowering apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
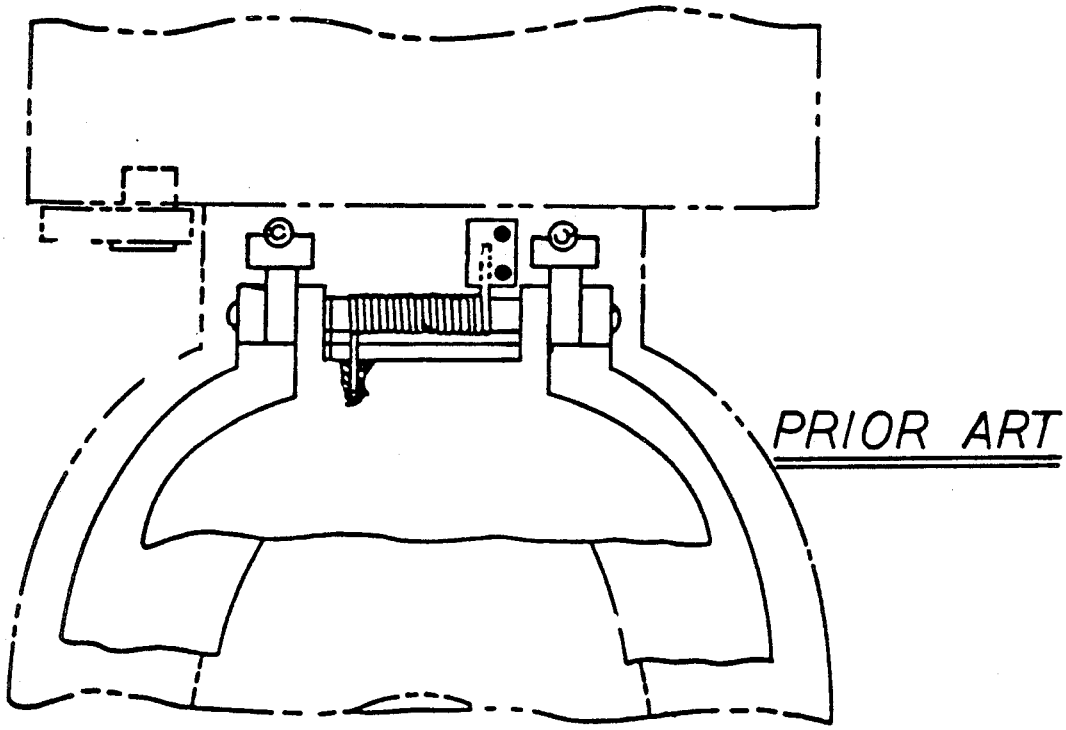
FIG. 1 is an orthographic top view of a commode seat lowering apparatus showing a spring-biased central rod, as indicated in U.S. Pat. No. 4,912,783.
Figure 2:
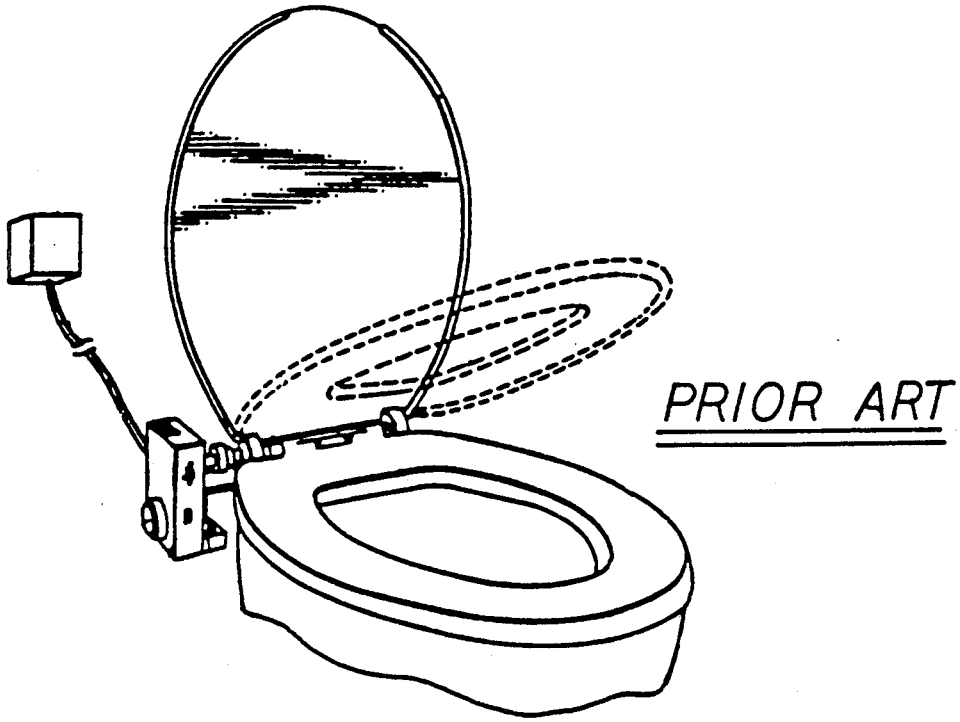
FIG. 2 is an isometric illustration of a toilet seat closing structure, as indicated in U.S. Pat. No. 4,995,120.
Figure 3:
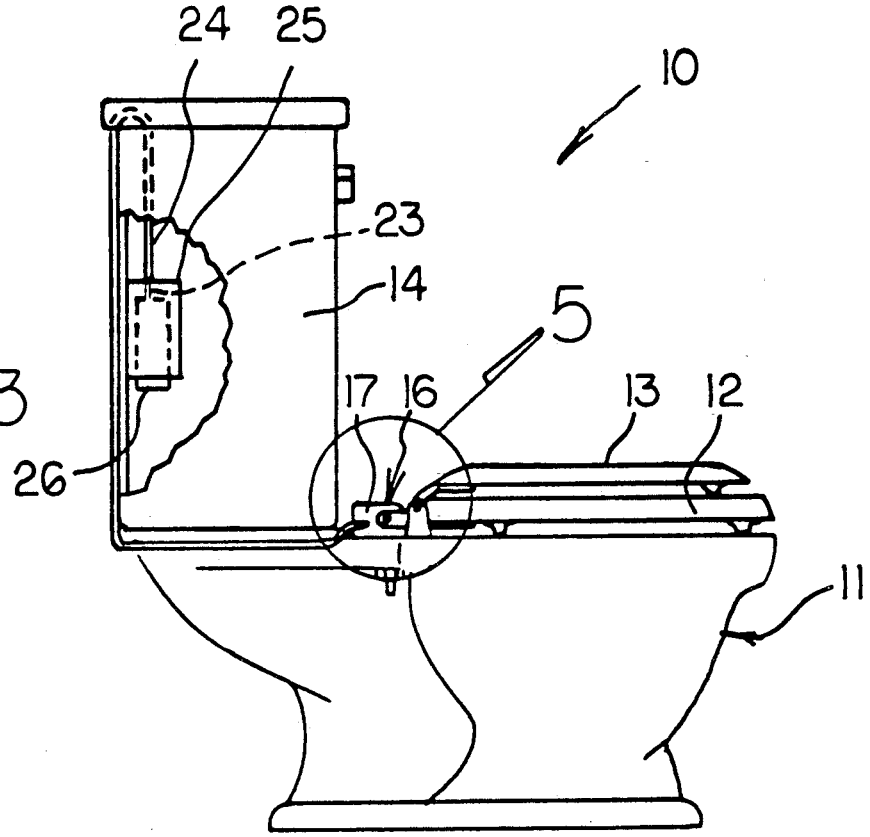
FIG. 3 is an orthographic side view of the invention, partially broken away.
Figure 4:
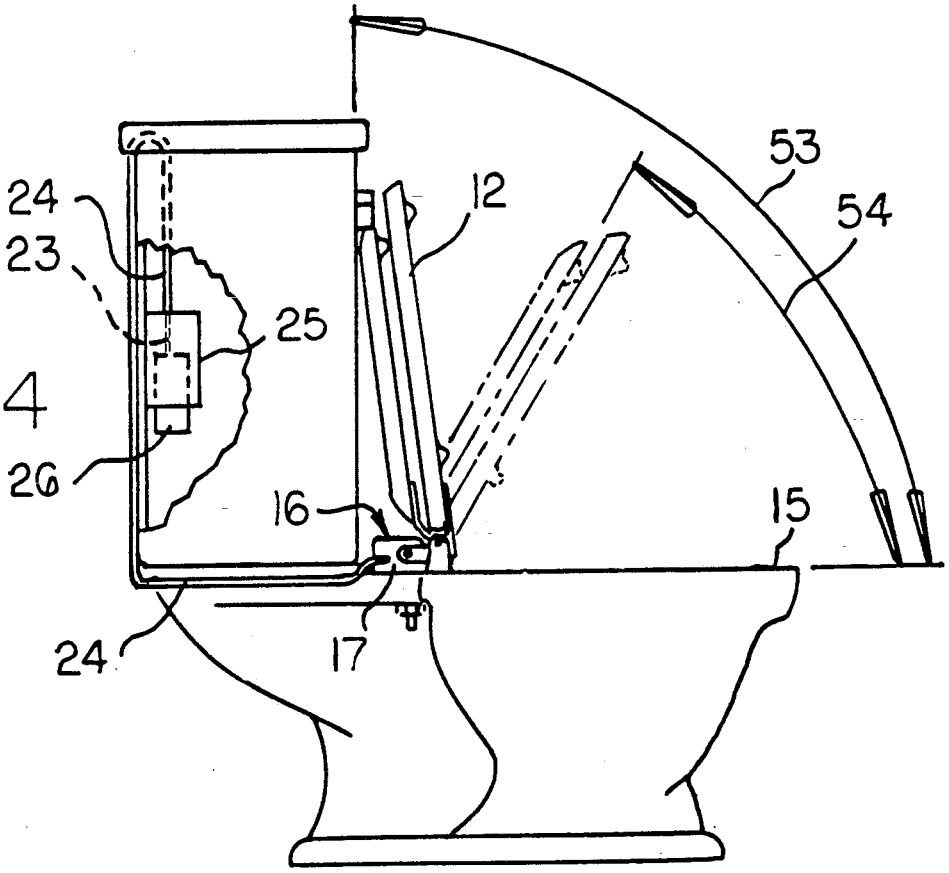
FIG. 4 is an orthographic side view of the invention, partially broken away, indicating the commode seat lowered from a first position to a second position prior to positioning of the commode seat to a third position in communication with the commode.
Figure 5:
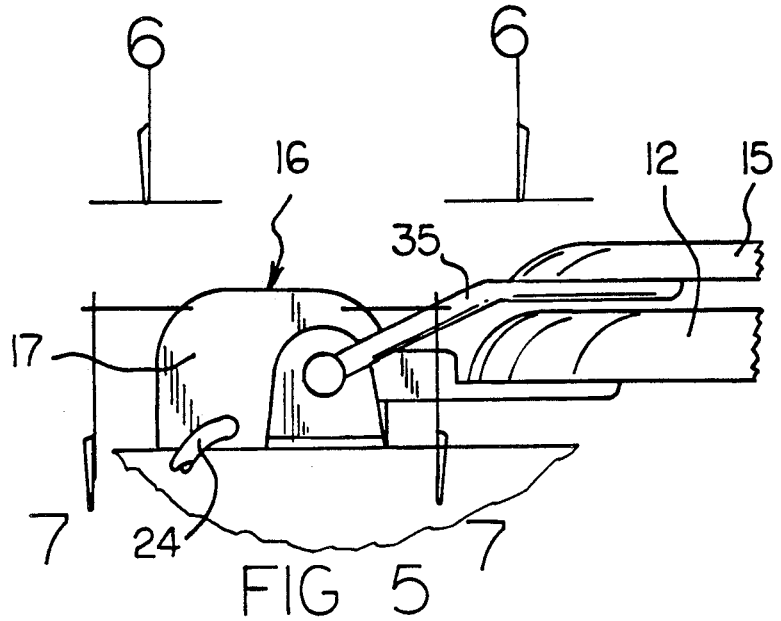
FIG. 5 is an enlarged orthographic view of section 5 as set forth in FIG. 3.
Figure 6:
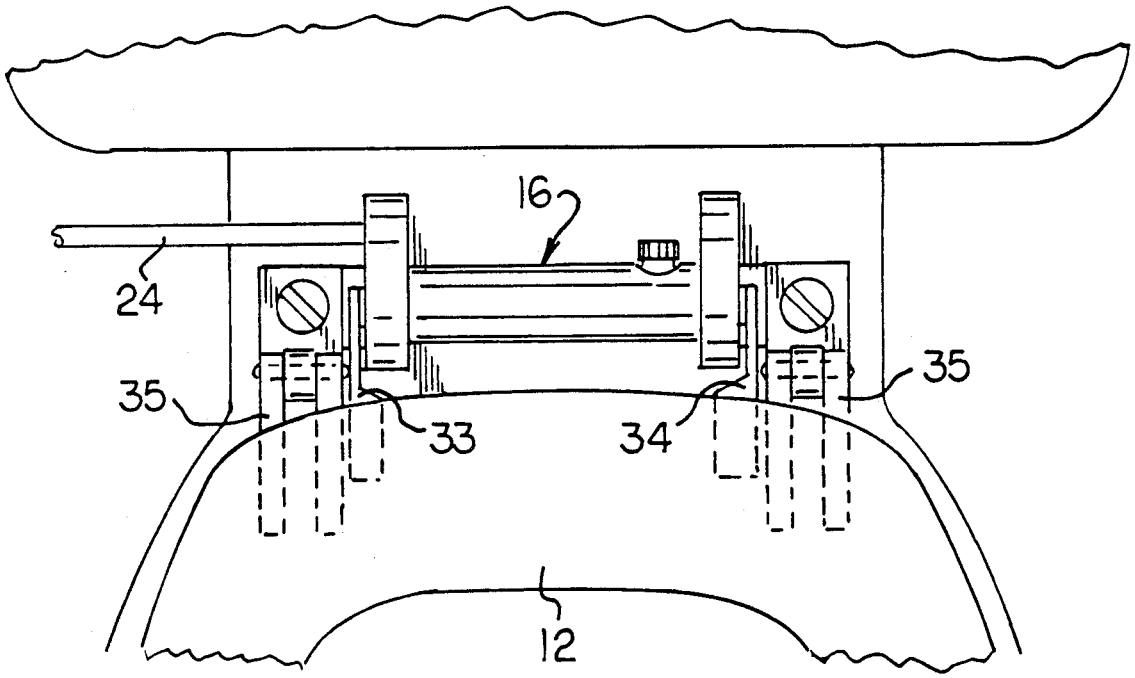
FIG. 6 is an orthographic view, taken along the lines 6—6 of FIG. 5 in the direction indicated by the arrows.
Figure 8:
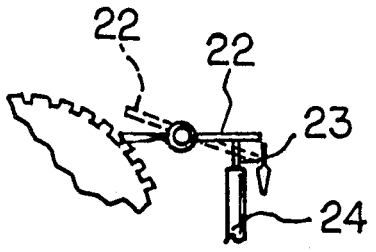
FIG. 8 is an orthographic view, taken along the lines 8—8 of FIG. 7 in the direction indicated by the arrows.
Figure 9:
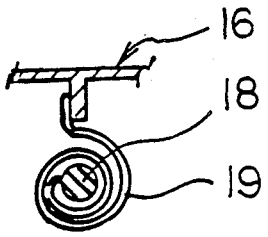
FIG. 9 is an orthographic view, taken along the lines 9—9 of FIG. 7 in the direction indicated by the arrows.
Figure 7:
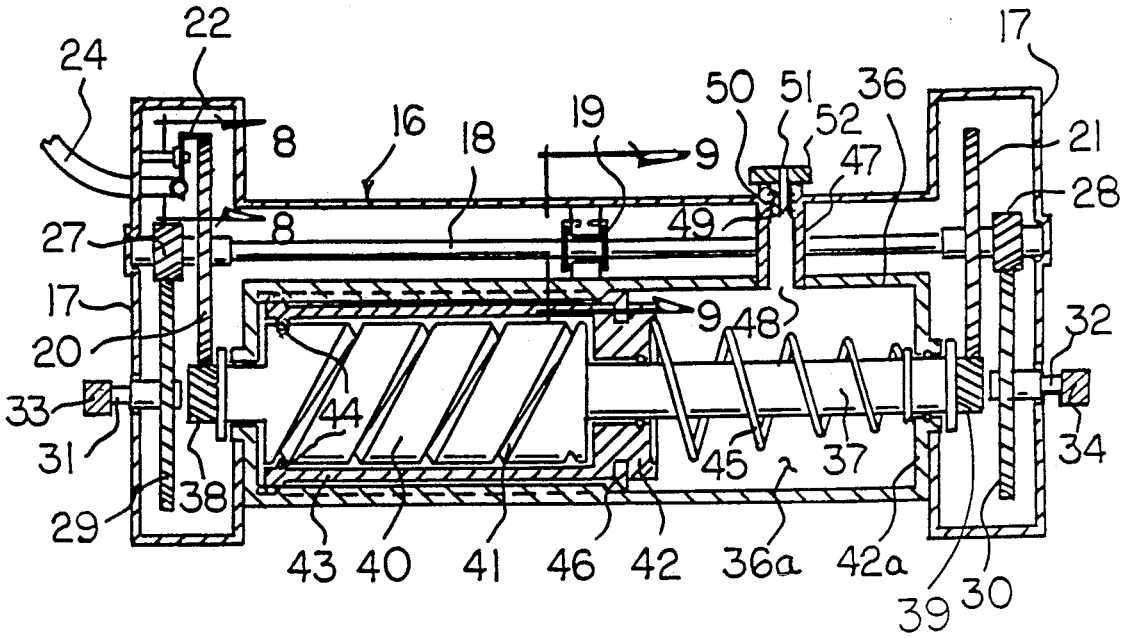
FIG. 7 is an orthographic view, taken along the lines 7—7 of FIG. 5 in the direction indicated by the arrows.

With reference now to the drawings, and in particular to FIGS. 1 to 9 thereof, a new and improved commode seat lowering apparatus embodying the principles and concepts of the present invention and generally designated by the reference numeral 10 will be described.

More specifically, the commode seat lowering apparatus 10 of the instant invention is arranged in operative association with a commode 11, having a commode seat 12 and an optional commode lid 13 as indicated. A fluid tank 14 is positioned and mounted upon the commode 11, with the commode arranged to include a commode top wall 15 to accommodate the commode seat 12 in an abutting relationship.

The apparatus 10 includes a control housing 16, having housing side walls 17, with a control rod 18 rotatably mounted relative to the side walls 17. A torsion spring 19 (see FIGS. 7 and 9) is secured to the control rod and to the housing 16, with the control rod having respective control rod first and second gears 20 and 21 mounted in adjacency relative to the first and second ends of the control rod 18. An L-shaped gear lock lever 22 is arranged for registration with and locking of the first gear 20, whereupon rotation of the control rod 18 upon lifting of the commode seat 12 by the gear relationship, in a manner to be discussed in more detail below, effects a rotation and winding of the torsion spring 19 against the housing 16 that is fixedly mounted to the commode top wall 15 in adjacency to the fluid tank 14. A cable 23 is provided, having its first end secured to the lock lever 22 and its second end mounted to a float member 26 within a float housing 25 that is positioned within the fluid tank 14. A cable sheath 24 fixedly surrounds the cable 23 from the housing 16 to the float housing 25. Upon water being directed from the fluid tank 14 during a flushing procedure, the cable first end displaces a lock lever 22 relative to the first gear 20 to release the gear and the associated control rod 18 against action of the torsion spring 19 upon lowering of the float member 26 relative to the float housing 25 within the fluid tank 14. Control rod third and fourth gears 27 and 28 are mounted in adjacency to the respective first and second gears 20 and 21 at the opposed first and second ends of the control rod 18, with a commode seat first gear 29 mounted to a first gear hub 31 and a commode seat second gear 30 mounted to a commode second gear hub 32, with the commode seat first and second support arms 33 and 34 mounted to the respective first and second gear hubs 31 and 32. In this manner, rotation of the commode seat from a third position in communication with the top wall 15 to a first position in communication with the fluid tank 14 effects rotation of the control rod 18 through the geared relationship of the commode seat first and second gears rotating the control rod third and fourth gears and simultaneously rotating the control rod 18. A cylinder housing 36 is provided that is oriented parallel to the control rod 18 within the housing 16, with the cylinder housing 36 having a dampening chamber 36*a* therewithin that is positioned between a piston 42 and a first end wall 42*a* of the housing 36. A rotary shaft 37 is rotatably mounted between the first end wall 42*a* and an opposing second end wall of the cylinder housing 36, with a first gear 38 mounted to the rotary shaft 37 in communication with the control rod first gear 20, with a rotary shaft second gear 39 mounted in communication with the control rod second gear 21 to effect rotation of the rotary shaft simultaneously upon rotation of the control rod 18. A rotary shaft cylindrical head 40 is provided fixedly mounted to the rotary shaft extending from the cylinder housing second end wall along the rotary shaft, and having a helical groove 41 directed into the rotary shaft cylindrical head 40. A piston 42 is provided, having a piston skirt 43 arranged to receive the rotary shaft cylindrical head 40. A piston skirt follower projection 44, or a plurality of such projections, are received within the helical grooves 41, whereupon rotation of the rotary shaft cylindrical head 40 effects simultaneous projection of the piston 42 from the cylinder housing second end wall towards the first end wall 42*a* against biasing of the spring 45 interposed between the piston 42 and the first end wall 42*a*. A piston sealing ring 46 mounted to the piston is arranged for sealing cooperation of the piston in pneumatic sealing relationship to the interior surface of the cylinder housing 36 within the dampening chamber 36*a*. Air thusly trapped within the dampening chamber 36*a* is slowly released through the pressure relief valve 47 that has a pressure relief valve bore 48. Conical threads 49 are directed within the relief valve bore 48, wherein a resilient insert shank 50 is provided exteriorly threaded, having an insert shank bore 51 and insert shank head 52. The insert shank bore 51 is directed through the insert shank, whereupon projection of the resilient insert shank 50 into the conical threads 49 effects constriction of the insert shank bore 51 to thereby control pressure relief from within the dampening chamber 36*a* to thereby moderate the rate of projection of the piston 42 towards the first end wall 42*a*.

In this manner in a first position, the commode seat 12 is arranged in adjacency to the fluid tank 14 defining an obtuse angle 53, whereupon flushing the tank the torsion spring 19 effects displacement of the commode seat to a second position defining an acute angle 54 of the seat relative to the top wall 15, whereupon gravity directs the commode seat to the third position in communication with the top wall 15 through the dampening action of the piston 42 being directed towards the first end wall 42*a*.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A commode seat lowering apparatus arranged for communication with a commode having a seat and a commode top wall, with a fluid tank mounted to the commode top wall in adjacency to the commode seat, the commode seat being movable between substantially vertical up and substantially horizontal down positions, wherein the apparatus comprises, a control housing, the control housing having opposing side walls, with a control rod rotatably mounted between the side walls, and a torsion spring mounted between the control rod and control housing for rotatably biasing the control rod in a first direction, and a control rod gear mounted to the control rod spaced from the torsion spring, and a commode seat gear in communication with the control rod gear, with the commode seat gear having a gear hub fixedly mounted to the commode seat gear, with the gear hub projecting through one of said control housing side walls, and a commode seat arm mounted to the hub and adapted to be mounted to the commode seat, a further commode seat arm rotatably mounted to the other of said control housing side walls and adapted to be mounted to the commode seat, and a control rod inner gear spaced relative to the control rod gear fixedly mounted to the control rod, and an elongate cylinder housing mounted within the control housing, wherein the cylinder housing longitudinal axis is arranged parallel relative to the control rod, with a rotary shaft rotatably mounted along the longitudinal axis of and through the cylinder housing, the cylinder housing having a first end wall spaced from a second end wall, with the rotary shaft having a rotary shaft gear in communication with the control rod inner gear, and dampening means mounted to the rotary shaft within the cylinder housing to dampen descent of the commode seat from the up position to the down position with the commode seat being biased from the up position by said torsion spring.

2. An apparatus as set forth in claim 1 wherein a pivotal lock lever is arranged for communication with the inner gear for selective latching of the inner gear, a cable having a cable first end mounted to the lock lever, the cable directed through a cable sheath, and a float housing adapted to be mounted within the fluid tank, with a float member mounted within the float housing, and the cable having a cable second end mounted to the float member, the cable sheath mounted between the control housing and the float housing, whereupon flushing of fluid from the fluid tank effects lowering of the float member within the float housing and displacement of the cable within the cable sheath to effect pivoting of the lock lever and disengagement of the lock lever relative to the inner gear to permit rotation of the control rod by the torsion spring.

3. An apparatus as set forth in claim 2 wherein the dampening means includes a rotary shaft cylinder head mounted to the rotary shaft and extending from the cylinder housing second end wall to a spaced relationship relative to the cylinder housing first end wall, and a piston arranged for receiving the rotary shaft cylinder head, and a helical groove directed into the rotary shaft cylinder head, the piston having a piston skirt, the piston skirt having a piston skirt projection, with the piston skirt projection arranged in engagement with the helical groove, and a spring interposed between the piston and the cylinder housing first end wall, whereupon rotation of the rotary shaft upon descent of the commode seat from the up position to the down position effects movement of the piston towards the cylinder housing first end wall, and a sealing ring mounted to the piston to sealingly contain fluid pressure within the cylinder housing between the piston and the cylinder housing first end wall, and valve means mounted to the cylinder housing to permit selective pressure relief from the cylinder housing between the piston and the cylinder housing first end wall.

4. An apparatus as set forth in claim 3 wherein the valve means includes a valve mounted to the cylinder housing in communication with the cylinder housing, having a valve bore in communication with the cylinder housing, the valve bore having conical threads, and a resilient insert shank directed into the conical threads, with the resilient insert shank including cylindrical threads, and a shank bore directed through the shank, whereupon projection and rotation of the insert shank within the conical threads effects constriction of the shank bore and pressure relief through the shank bore.

* * * * *